US008136186B1

(12) United States Patent
Leach

(10) Patent No.: US 8,136,186 B1
(45) Date of Patent: Mar. 20, 2012

(54) PILLOW ASSEMBLY

(76) Inventor: Jamie S. Leach, Ada, OK (US)

( * ) Notice: Subject to any disclaimer, the term of this patent is extended or adjusted under 35 U.S.C. 154(b) by 0 days.

(21) Appl. No.: 12/899,301

(22) Filed: Oct. 6, 2010

(51) Int. Cl.
*A47C 20/00* (2006.01)
*A61G 7/065* (2006.01)

(52) U.S. Cl. ..... 5/631; 5/632; 5/652; 5/657

(58) Field of Classification Search ..... 5/630, 631, 5/632, 652, 655, 657; 128/871
See application file for complete search history.

(56) References Cited

U.S. PATENT DOCUMENTS

| | | | | |
|---|---|---|---|---|
| 1,447,288 | A | 2/1921 | Emmerich | |
| D124,296 | S | 12/1940 | Thompson | |
| 2,857,957 | A | 10/1958 | Gay | |
| 2,952,856 | A | 9/1960 | Ruff | |
| 3,693,190 | A | 9/1972 | Hickling | |
| 3,761,131 | A | 9/1973 | Oliver | |
| 3,775,785 | A | 12/1973 | Mittendorf | |
| D230,804 | S | 3/1974 | Lijewski | |
| 3,911,512 | A | 10/1975 | Plate | |
| 3,924,282 | A * | 12/1975 | Bond | 5/632 |
| 4,027,888 | A | 6/1977 | Wilcox | |
| 4,171,549 | A | 10/1979 | Morrell et al. | |
| 4,194,254 | A | 3/1980 | Torrez | |
| 4,393,530 | A | 7/1983 | Stark | |
| 4,506,396 | A | 3/1985 | Ritchie, Jr. et al. | |
| 4,607,402 | A | 8/1986 | Pollard | |
| 4,754,509 | A | 7/1988 | Pollard | |
| D299,988 | S | 2/1989 | Parabita | |
| 4,834,459 | A | 5/1989 | Leach | |
| 4,836,605 | A | 6/1989 | Greenwood et al. | |
| 4,861,109 | A | 8/1989 | Leach | |
| D303,897 | S | 10/1989 | Phillips | |
| D309,018 | S | 7/1990 | Leach | |
| 4,970,742 | A | 11/1990 | Keener | |
| 4,987,625 | A | 1/1991 | Edelson | |
| 5,103,514 | A | 4/1992 | Leach | |
| 5,165,130 | A | 11/1992 | Wendling | |
| 5,182,828 | A * | 2/1993 | Alivizatos | 5/631 |
| 5,193,238 | A | 3/1993 | Clute | |
| 5,216,772 | A | 6/1993 | Clute | |
| 5,272,780 | A | 12/1993 | Clute | |

(Continued)

OTHER PUBLICATIONS

The My Brest Friend pillow product, which is shown and described in the webpage attached as Exhibit A to this Statement, was in public use and/or on sale at least since prior to the filing date of this application, that is, prior to Oct. 6, 2010.

(Continued)

*Primary Examiner* — Michael Trettel
(74) *Attorney, Agent, or Firm* — Mary M. Lee

(57) ABSTRACT

A multi-purpose pillow assembly. The assembly may comprise long short pillows with an underbody pad extending between them. A sleeve surrounds the long pillow and is attached to the side of the underbody pad opposite the short pillow. The sleeve can be rotated around the circumference of the long pillow and moved along its length, providing an assortment of possible configurations. Rotating the sleeve adjusts the distance between the long and short pillows for accommodating the girth of the user. The short pillow can be positioned on either side of the long pillow or on top of it. In another embodiment, the pillow assembly comprises a short pillow with an attached under body panel. In addition to its use as a support pillow for a user in a reclining position, this pillow assembly may serve as a back support pillow in a chair or other seat.

23 Claims, 13 Drawing Sheets

U.S. PATENT DOCUMENTS

| | | | | |
|---|---|---|---|---|
| 5,325,818 | A | 7/1994 | Leach | |
| 5,341,531 | A | 8/1994 | Straub et al. | |
| 5,359,739 | A | 11/1994 | Rains et al. | |
| 5,450,640 | A | 9/1995 | Patton et al. | |
| 5,499,418 | A * | 3/1996 | Tan et al. | 5/655 |
| D369,054 | S | 4/1996 | Straub et al. | |
| 5,530,974 | A * | 7/1996 | Rains et al. | 5/81.1 T |
| 6,049,929 | A | 4/2000 | Rawson | |
| 6,067,679 | A * | 5/2000 | Rice | 5/630 |
| 6,170,908 | B1 | 1/2001 | Jewell | |
| D450,517 | S | 11/2001 | Darling et al. | |
| 6,343,727 | B1 | 2/2002 | Leach | |
| 6,427,251 | B1 | 8/2002 | Leach | |
| 6,499,164 | B1 | 12/2002 | Leach | |
| 6,553,590 | B1 | 4/2003 | Leach | |
| 6,560,800 | B1 * | 5/2003 | Draves | 5/630 |
| 6,574,810 | B2 | 6/2003 | Mangiaracina | |
| 6,601,252 | B1 | 8/2003 | Leach | |
| 6,751,817 | B1 | 6/2004 | Leach | |
| 6,760,934 | B1 | 7/2004 | Leach | |
| 6,886,201 | B1 | 5/2005 | Weiss-Lohrei | |
| 7,010,821 | B1 | 3/2006 | Leach | |
| 7,086,101 | B2 * | 8/2006 | Welch et al. | 5/428 |
| 7,114,206 | B2 | 10/2006 | Leach | |
| 7,117,553 | B2 * | 10/2006 | Fairchild et al. | 5/655 |
| 7,331,073 | B2 | 2/2008 | Littlehorn et al. | |
| 7,353,552 | B2 | 4/2008 | Leach | |
| 7,500,278 | B2 | 3/2009 | Leach | |
| 7,513,001 | B1 | 4/2009 | Leach | |
| 7,562,406 | B1 | 7/2009 | Leach | |
| 7,676,871 | B1 | 3/2010 | Leach | |
| 7,708,342 | B2 | 5/2010 | Leach | |
| 7,793,371 | B1 | 9/2010 | Leach | |
| 7,874,032 | B2 * | 1/2011 | North et al. | 5/632 |
| 7,878,587 | B1 | 2/2011 | Leach | |
| 7,926,135 | B1 | 4/2011 | Leach | |
| 2005/0278864 | A1 | 12/2005 | Leach | |
| 2006/0031992 | A1 | 2/2006 | Moore | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0180623 | A1 | 8/2007 | Stein et al. | |
| 2007/0277321 | A1 | 12/2007 | Leach | |

OTHER PUBLICATIONS

The Dex Pregnancy Pillow, which is shown and described in the webpage attached as Exhibit B to this Statement, was in public use and/or on sale at least since prior to the filing date of this application, that is, prior to prior to Oct. 6, 2010.

The Boppy Pregnancy Wedge pillow, which is shown and described in the webpage attached as Exhibit C to this Statement, was in public use and/or on sale at least since prior to the filing date of this application, that is, prior to prior to Oct. 6, 2010.

The Basic Comfort Ultimate Pregnancy Pillow, which is shown and described in the webpage attached as Exhibit D to this Statement, was in public use and/or on sale at least since prior to the filing date of this application, that is, prior to Oct. 6, 2010.

The Leachco Best Rest Pregnancy Comfort Wedge, which is shown and described in the webpage attached as Exhibit E to this Statement, was in public use and/or on sale at least since prior to the filing date of this application, that is, prior to prior to Oct. 6, 2010.

The Leachco The Natural Nursing Pillow, which is shown and described in the webpage attached as Exhibit F to this Statment, was in public use and/or on sale at least since prior to the filing date of this application, that is, prior to prior to Oct. 6, 2010.

U.S. Appl. No. 11/849,431, filed Sep. 4, 2007, Leach.

U.S. Appl. No. 13/085,300, filed Apr. 12, 2011, Leach.

* cited by examiner

PILLOW ASSEMBLY

FIELD OF THE INVENTION

The present invention relates generally to body support pillows.

BACKGROUND OF THE INVENTION

Body support pillows enjoy increasing popularity among consumers. While one major use is to provide back and belly support for expectant mothers, many others use body pillows for general back and leg support while sleeping or reclining. While many body pillows presently are available, there remains a need for more versatility and for pillows that provide multiple functions.

DETAILED DESCRIPTION OF THE PREFERRED EMBODIMENTS

Figure 1:
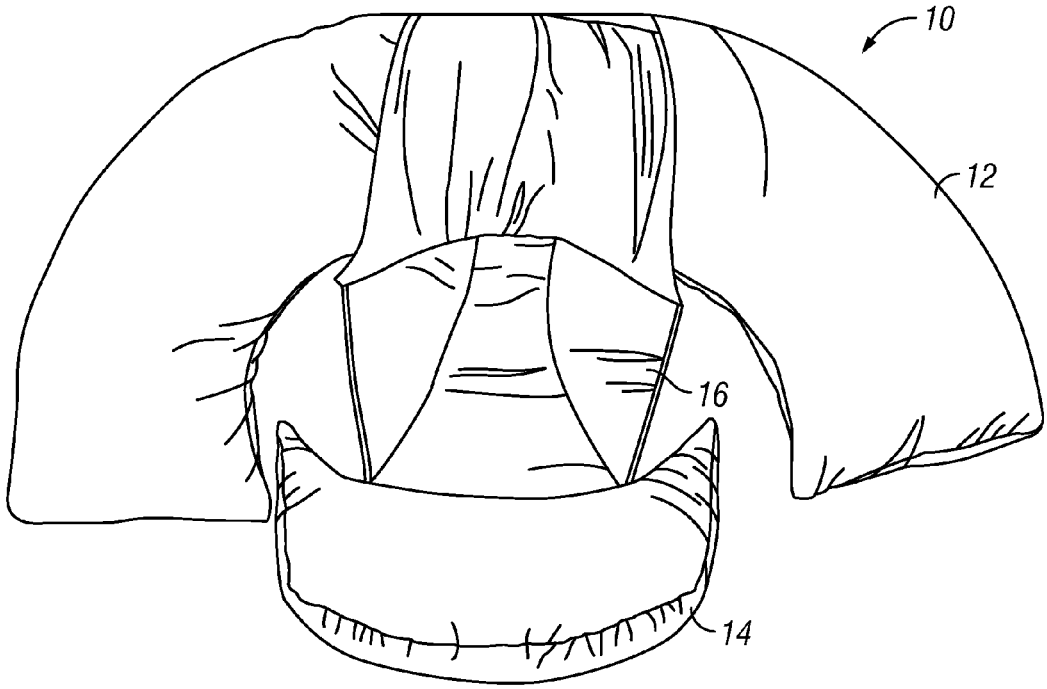
FIG. 1 is a plan view of a pillow assembly made in accordance with a preferred embodiment of the present invention. The pillow comprises a long pillow and a short pillow and an underbody panel extending between them. A sleeve attached to the end of the underbody panel surrounds the body of the long pillow. The other end of the underbody panel is attached to the inner perimeter of the short pillow.

Turning now to the drawings in general and to FIG. 1 in particular, there is shown therein a pillow assembly made in accordance with a first embodiment of the present invention and designated generally by the reference numeral 10. The pillow assembly 10 generally comprises a long body pillow 12 and a short pillow 14 with an underbody pad 16 extending between them.

Figure 2:
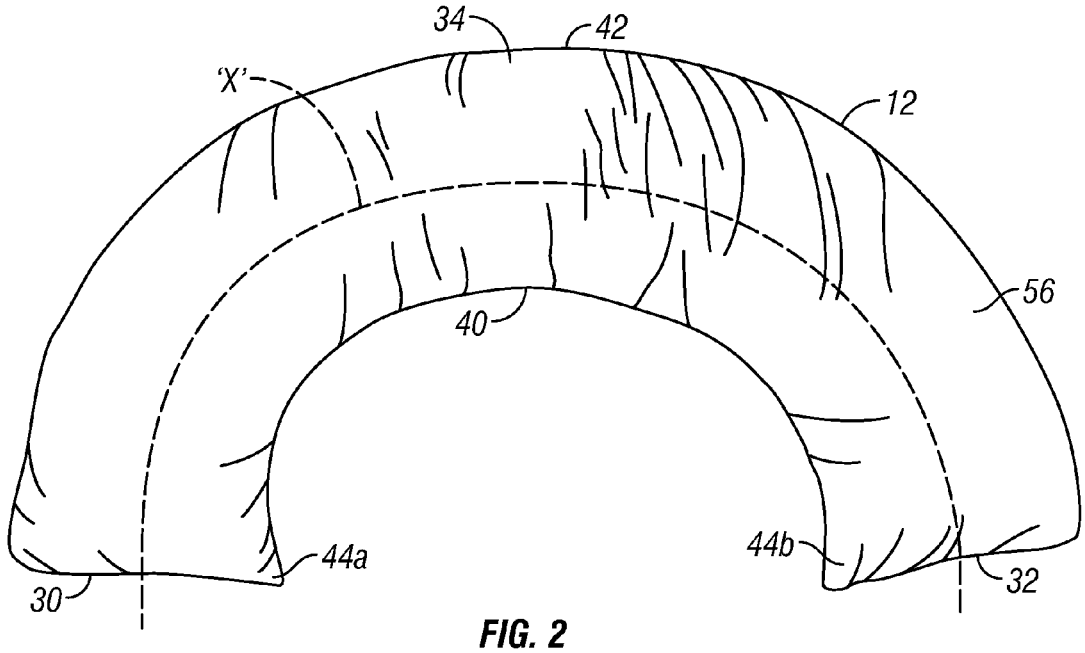
FIG. 2 is a plan view of the long pillow of the pillow assembly in FIG. 1 shown in its resting position.

The preferred long body pillow 12 is shown in FIGS. 2-6. The long pillow 12 has a first end 30, a second end 32, and body 34 extending therebetween. The body 34 of the pillow 12 is much longer than it is wide. The ideal shape of the pillow 12 is curved and most preferably is semi-circular (FIG. 2). The advantages of this semi-circular shape will become apparent later as the various uses are explained.

Figure 6:
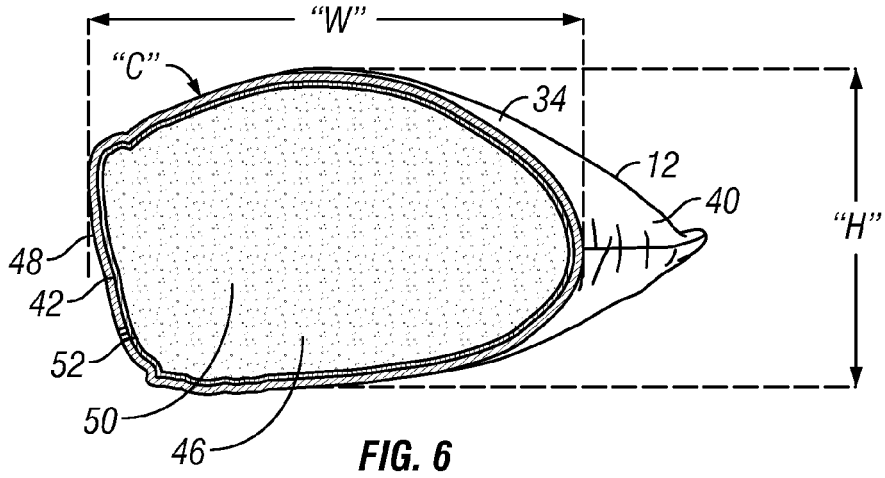
FIG. 6 is cross-sectional view of the long pillow taken along the line 6-6 in FIG. 3.
Figure 7:
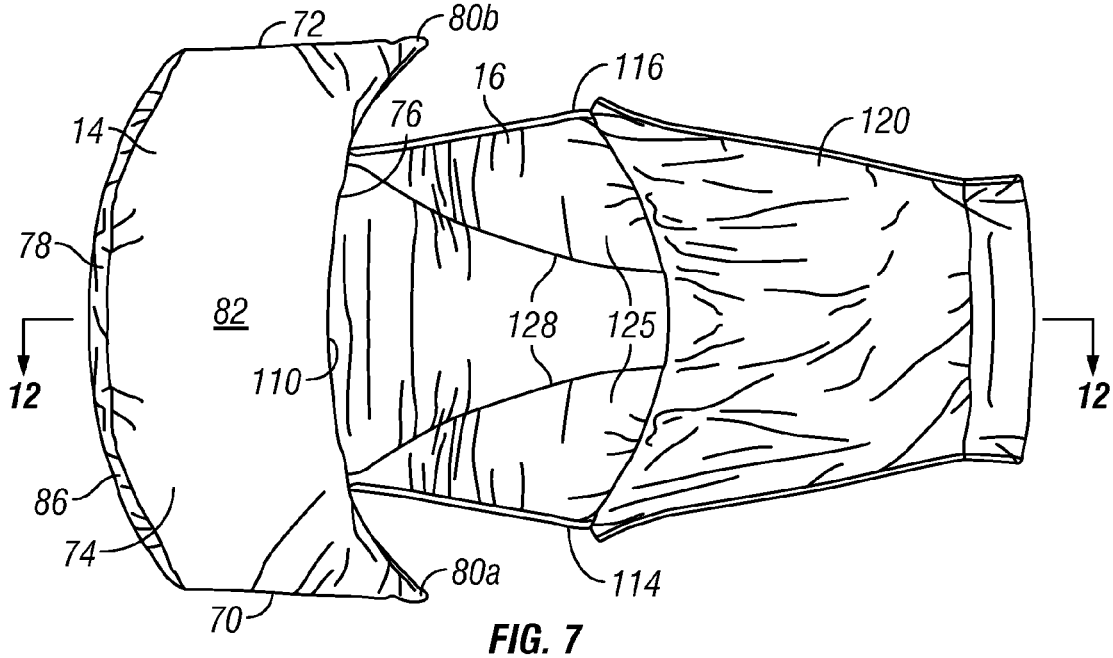
FIG. 7 is a plan view of the short pillow with the attached underbody panel and sleeve.
Figure 8:
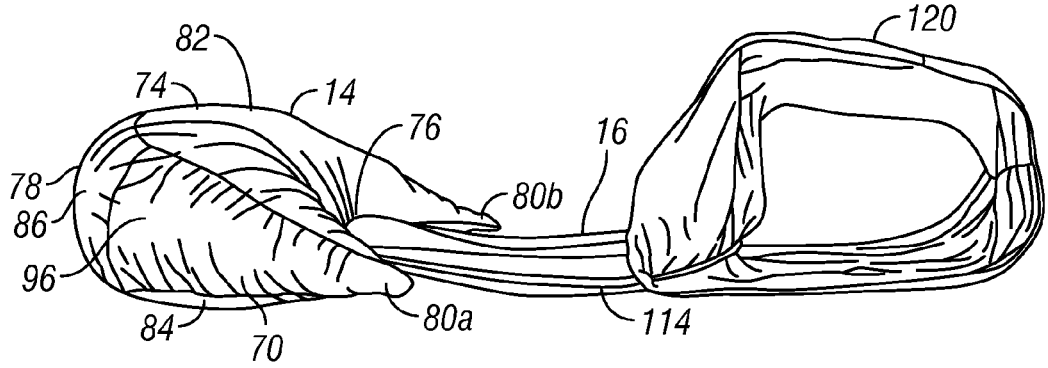
FIG. 8 is an end elevational view of the short pillow with the attached underbody panel and sleeve.
Figure 9:
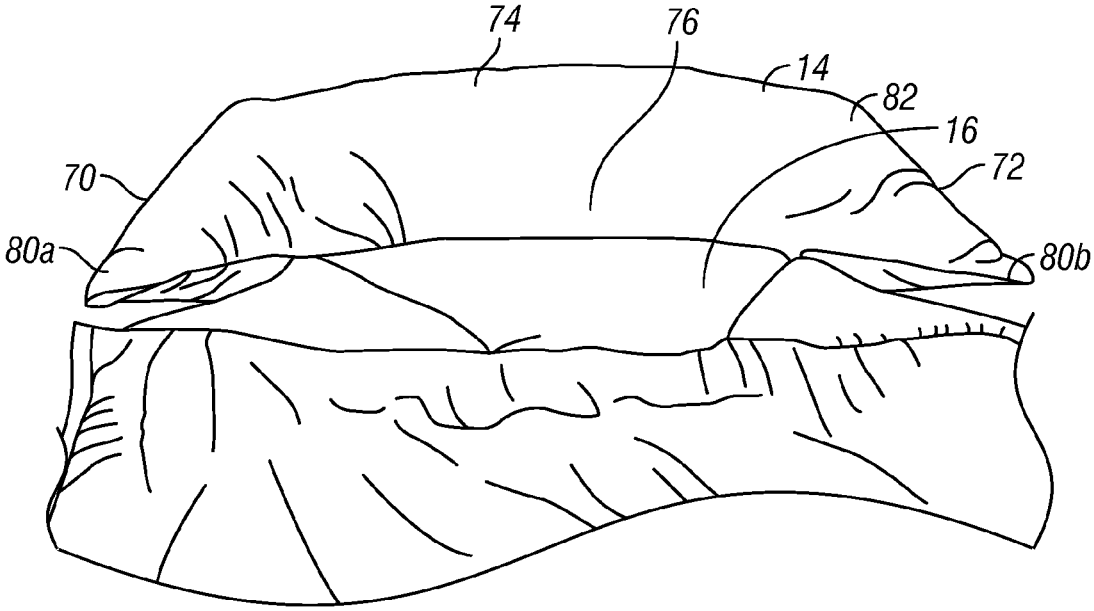
FIG. 9 is a front elevational view of the short pillow shown with the attached underbody panel and sleeve.

The boundary of the cross-sectional shape, seen in FIG. 6, is referred to herein as "circumference," and is designated in the drawings by the letter "C." As used herein, "circumference" denotes the general boundary of the pillow 12 and does not indicate a circular shape in cross-sectional. Rather, the cross-sectional shape of the pillow 12, as well as the pillow 14 described hereafter, may take various shapes such as oval and polygonal. As shown in FIG. 6, the long pillow body 34 has a width "W" and a height "H," the width in this embodiment being slightly greater than its height. The preferred width "W" of the pillow body 34 is from about 8 inches to about 16 inches and most preferably about 12 inches. The preferred height "H" of the pillow body 34 is about 6 inches to about 14 inches and most preferably is about 10 inches.

The body 34 has a length "L" (FIG. 3) selected to optimize the pillow's use as an adult body pillow, as explained more fully hereafter. To that end, the length is preferably about 40 to about 60 inches. For example, about 50 inches is an ideal length. The length of the center line "X" following the curve of the body 34, shown in broken lines in FIG. 2, is about 65 inches.

Figure 3:
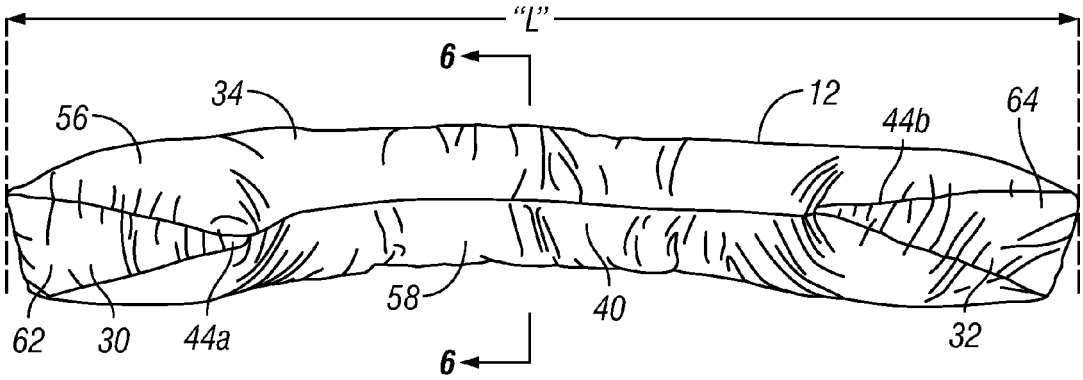
FIG. 3 is a front elevational view of the long pillow shown in FIG. 2.
Figure 4:
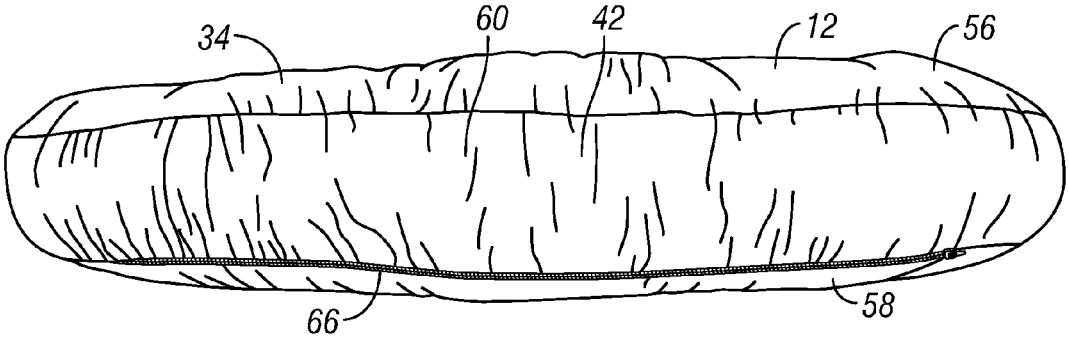
FIG. 4 is a rear elevational view of the long pillow shown in FIG. 2.
Figure 5:
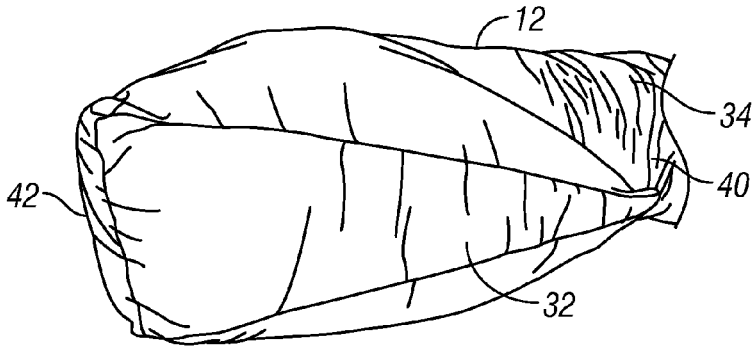
FIG. 5 is an elevational view of end of the long pillow shown in FIG. 2, the opposite end being a mirror image thereof.

The inner perimeter 40 is best seen in FIG. 3 showing the front of the pillow 12. FIG. 4 shows the outer perimeter 42 on the back or rear of the pillow 12. In its preferred form, the long pillow 12 comprises tapered or wedge-shaped end panels providing tapered corners 44*a* and 44*b* (FIGS. 2&3) on the inner perimeter 40 of the pillow.

As best seen in FIG. 6, the pillow 12 preferably comprises an inner pillow form 46 and a removable cover 48. The pillow form 46 may comprise a compressible filler 50 inside a fabric enclosure 52. The fabric enclosure 52 material may be any suitable fabric, including but not limited to waterproof nylon, flannel, muslin, or elastic fabrics, such as spandex or cotton-spandex blends. However, presently a polyester/cotton blend is preferred.

The compressible, resilient material 50 may be solid or loose. For example, a preferred loose filler is polyester fiber-fill. Other suitable fillers include down feathers, memory foam, polystyrene pellets. In some instances, the pillow form 46 may comprise an inflatable enclosure. This construction provides a continuous compressible and resilient pillow form.

Although several methods of making the pillow 12 will be apparent to those skilled in the art, a preferred method includes the use of several panels of fabric. Referring to FIGS. 2-4, first and second (top and bottom) panels 56 and 58 having the shape shown in FIG. 2 may be sewn together along the inside edge to form the inner perimeter 40. The outer edges of the top and bottom panels 56 and 58 are sewn to opposite long edges of a side panel 60 (FIG. 4), which forms the outer perimeter 42. First and second end panels 62 and 64 (FIG. 3) are sewn to the end edges of the top, bottom and side panels 56, 58, and 60, forming the ends 30 and 32 of the pillow 12.

In those instances where the cover 58 is to be removable, an opening is provided in the cover. For example, in the embodiment shown a zipper 66 is included along one of the seams, as seen best in FIG. 4. Alternately, the opening could be a sham-style closure or could be closed with hook-and-loop fasteners, or with buttons, ties, snaps, hooks, or any suitable fastener.

The fabric enclosure 52 of the pillow form 46 may be made in a similar manner, although usually a zipper or other closure is unnecessary. Typically, the fabric enclosure 52 will be permanently closed to prevent the loss of filler material. The fabric enclosure 52 may be made of any suitable material. Ideally, it is made of relatively slick (low friction) fabric, to facilitate the removal and reinsertion of the pillow form 46 in the removable cover 58.

Turning now to FIGS. 7-12, the short pillow 14 and the underbody pad 16 will be described. The short pillow 14 comprises a first end 70, a second end 72 and a body 74 extending therebetween. The body 74 has an inner perimeter 76 and an outer perimeter 78.

The short pillow 14 is shorter than the long pillow 12. It is sized to support only the belly or only the back. Accordingly, it may be about 15 inches to about 35 inches, and preferably is about 25 inches long. The short pillow 14 may be slightly curved, and preferably is longer than it is wide, but other shapes may be utilized. In the most preferred form, the short pillow has a width "W" (FIG. 12) of about 6 inches to about 14 inches, and most preferably about 10 inches, but this may vary. The preferred height "H" (FIG. 12) of the pillow body 74 is about 4 inches to about 10 inches and most preferably is about 7 inches. Thus, the width "W" may be slightly greater than the height "H," as in the pillow 12.

Figure 10:
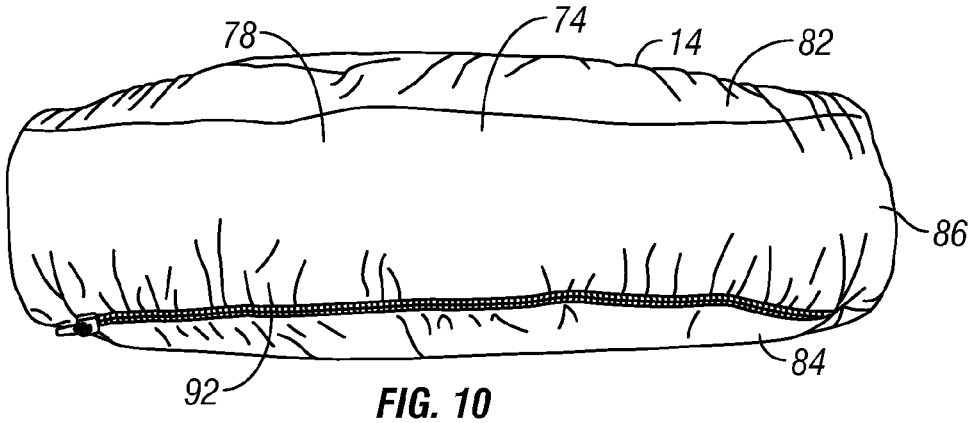
FIG. 10 a rear elevational view of the short pillow.
Figure 11:
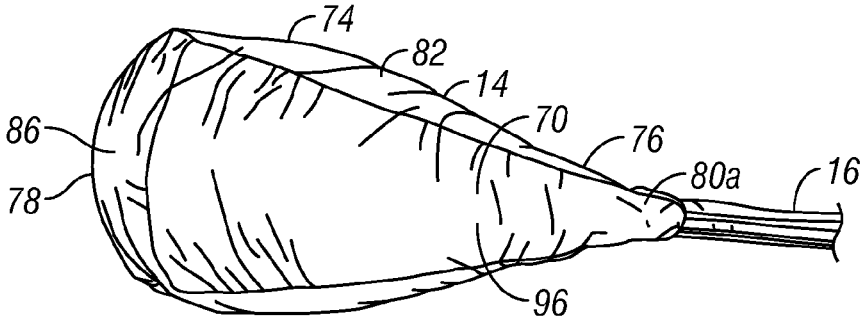
FIG. 11 is an end elevational view of the short pillow.

Like the long body pillow 12, the short pillow 14 preferably has tapered corners 80*a* and 80*b* (FIGS. 7-9) on the ends 70 and 72. Thus, the preferred manner of making the short pillow 14 is similar. That is, top and bottom panels 82 and 84 are joined at the inner perimeter 76, and the outer perimeter 78 is formed by a side panel 86. Again, a seam on one of the long edges of the side panel 84 is an ideal location for a zipper 92 (FIG. 10). End panels 96 sewn to the end edges of the top, bottom and side panels 82, 84, and 86 provide tapered inner corners, best seen in FIG. 8.

Figure 12:
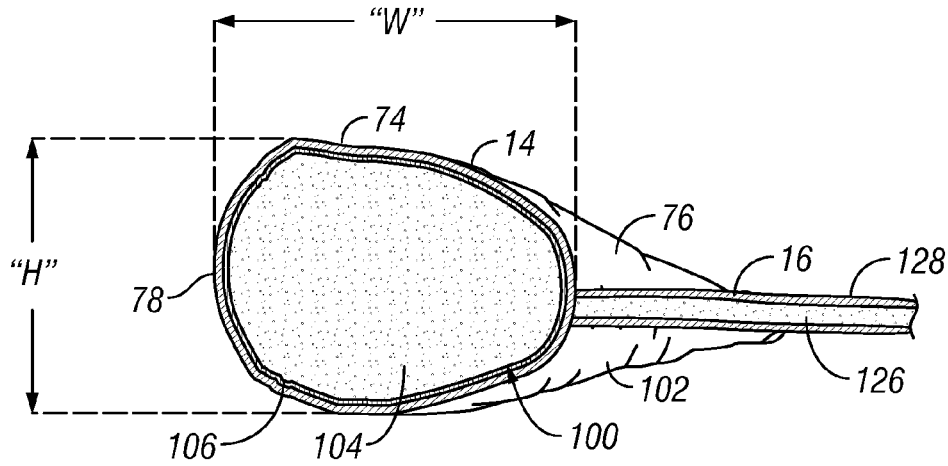
FIG. 12 is a cross-sectional view of the short pillow taken along the line 12-12 in FIG. 7.

Like the pillow 12, the short pillow 14 also preferably comprises an inner pillow form 100 and a removable cover 102, as seen in FIG. 12. The pillow form 100 may comprise a compressible filler 104 inside a fabric enclosure 106. The fabric enclosure 106 and the filler 104 may be made of the same materials as in the long pillow 12.

Referring still to FIGS. 7-12, the underbody pad 16 is generally flat in comparison to the long and short pillows 12 and 14. The pad 16 has a first end edge 110 and a second end edge 112 and two side edges 114 and 116. The first end edge 110 is attached to the inner perimeter 76 of the short pillow 14. This attachment may be permanent or releasable. In the embodiment shown, the attachment is permanent, being sewn into the seam between the top and bottom panels 82 and 84. Other releasable forms of attachment, such as hook-and-loop fasteners, zippers, and the like, may be employed instead, where a releasable attachment is desired.

A sleeve 120 is attached to the second, opposite end edge 102. The sleeve shown is a double layer of fabric, without filler or batting. However, the sleeve may be made with a single layer of fabric or it may include some filler or batting.

In the embodiment shown, the sleeve 120 is sewn to the edge 102 of the panel 16, that is, the sleeve is permanently attached to the pad 16. However, this attachment may be releasable, as by using hook-and loop fasteners, zippers, and the like. In addition, the sleeve 120 in this embodiment is a solid fabric tube. It is to be understood that the sleeve 120 may alternately comprises a pair of tabs or flaps that overlapping or connect to each other in some suitable fashion.

The sleeve 120 is shorter than the long pillow 12 and is sized to receive the body 34 of the long pillow and to be movable rotatably around the circumference "C" of the long pillow as well as slidably from one end 30 to the other 32 along its length. In this way, for reasons which will become apparent, the position of the sleeve 120 along the length "L," or in the case of the curved pillow shown in FIG. 2, along the curvature "X" of the pillow, may be adjusted. The position of the sleeve 120 around the circumference of the long pillow 12 also can be adjusted, and the two adjustments can be made independently of each other.

Although generally flat, the underbody pad 16 may contain some thickener or filler. In the embodiment shown, the pad comprises a thin layer of foam 126, as seen in FIG. 12. Alternately, batting or other layers of fabric may be used. However, no filler or extra thickness in the pad 16 is essential. The position of the filler 126 inside the fabric enclosure 128 (FIG. 12) may be secured by one or more stitched seams 128 (FIG. 7), which also serve to retain the generally flat configuration.

Figure 13:
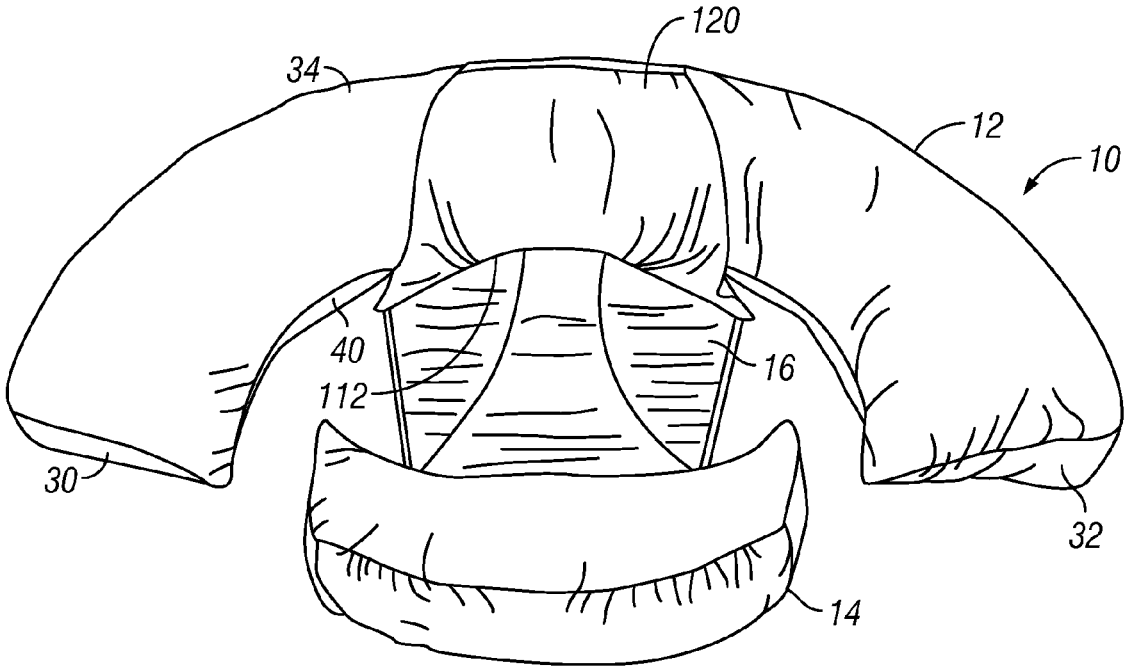
FIG. 13 is a perspective view of the pillow assembly shown in a first configuration.
Figure 14:
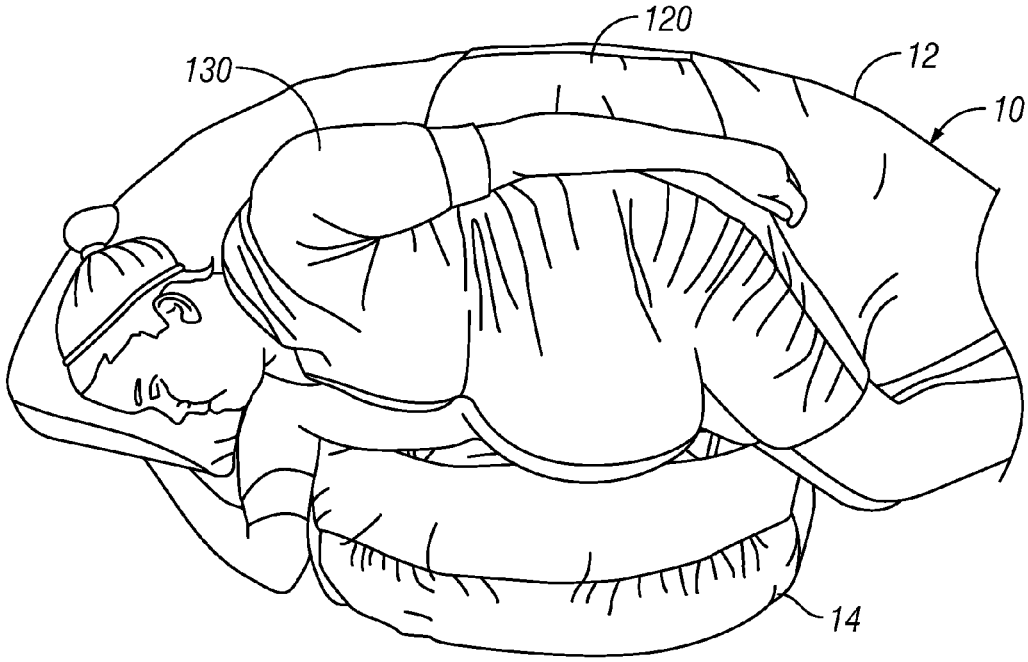
FIG. 14 is a front perspective view of the pillow assembly in the configuration shown in FIG. 13. A pregnant woman is shown on her side, lying between the long and short pillows with her belly resting on the short pillow.

Having described a preferred structure for the pillow assembly 10 of the present invention, its use now will be explained. A first configuration is shown in FIG. 13. The sleeve 120 is roughly centered on the body 34 of the long pillow 12, and the edge 112 of the underbody pad 16 is adjacent the inner perimeter 40. One use of this configuration is illustrated in FIG. 14. A woman 130 well into her pregnancy is shown lying on her side between the pillows 12 and 14 and over the pad 16. The woman's large belly is supported on the pillow 14, and her back rests against the body 34 of the long pillow 12. Because the long pillow 12 is curved, one end extends under the woman's head, and the opposite end can be used to separate her knees. Throughout the night, as the woman occasionally shifts her position, the relative positions of the long and short pillows 12 and 14 are maintained by the underbody pad 16.

Figure 15:
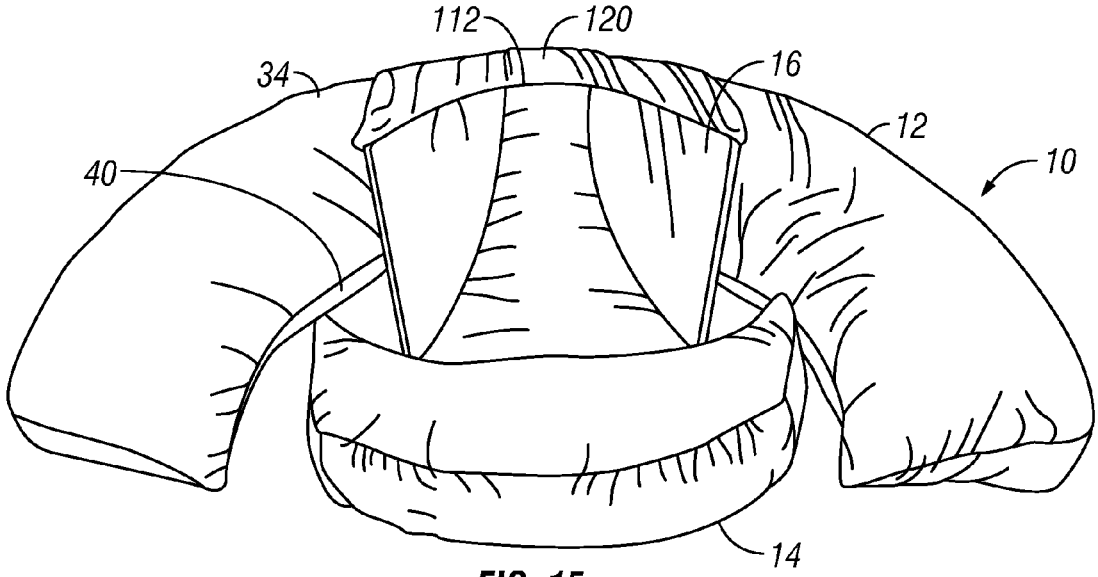
FIG. 15 is a front perspective view of the pillow assembly in a second configuration with the sleeve rotated on the long pillow so that the edge of the underbody panel is drawn up onto the top of the long pillow, pulling the short pillow closer in towards the inner perimeter of the long pillow.
Figure 16:
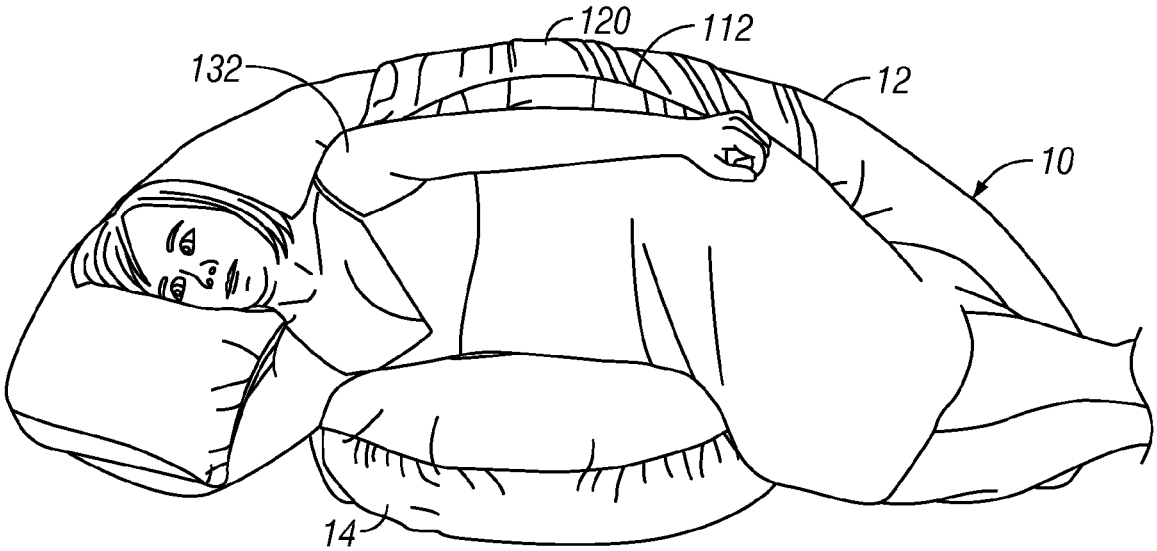
FIG. 16 is a front perspective view of the pillow assembly in the configuration shown in FIG. 15. A pregnant woman is shown on her side, lying between the long and short pillows with her belly resting on the short pillow.
Figure 17:
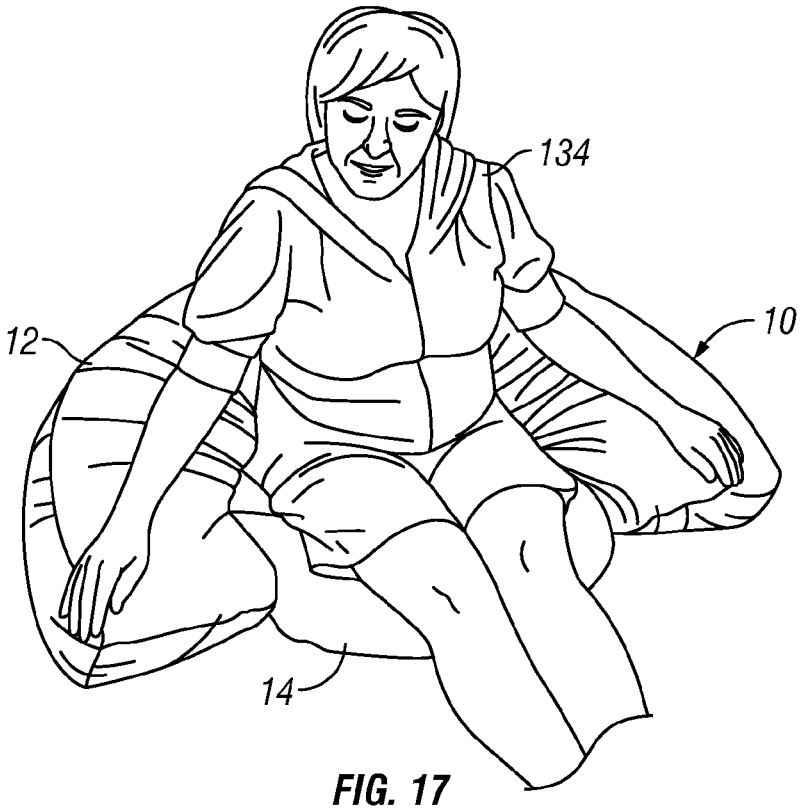
FIG. 17 is a front perspective view of the pillow assembly in the configuration shown in FIG. 15. A woman is shown seated on the underbody panel with her knees supported by the short pillow and her back supported by the long pillow.

Another configuration of the pillow assembly 10, shown in FIG. 15, is achieved by rotating the sleeve 120 around on the body 34 of the pillow 12 until the edge 112 is pulled up over the top of the long pillow. This draws the short pillow 14 closer in toward the inner perimeter 40 of the long pillow 12. As shown in FIG. 16, this more compact arrangement renders the assembly 10 comfortable for a woman 132 earlier in her pregnancy or by a non-pregnant individual, man or woman, or even by a larger child or adolescent in need of such support. Still further, as seen in FIG. 17, this same compact arrangement may serve as a seat support for an individual 134, the long pillow 12 providing back support and arm rests, while the short pillow 14 supports the knees.

Figure 18:
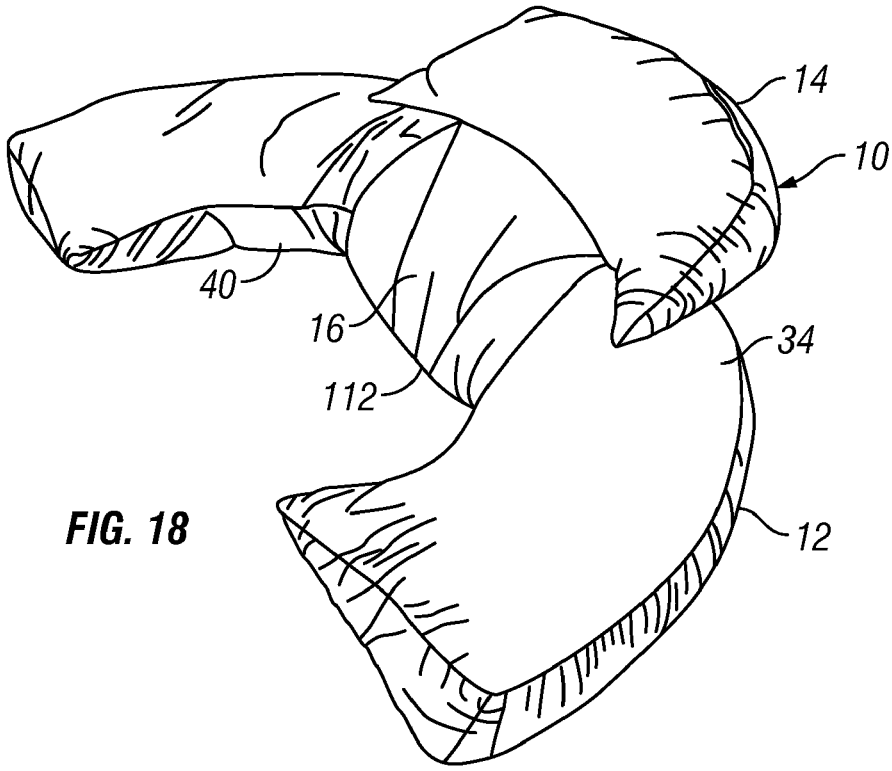
FIG. 18 is a side perspective view of the pillow assembly in a third configuration. The underbody panel is folded up and the short pillow is resting on top of the long pillow.
Figure 19:
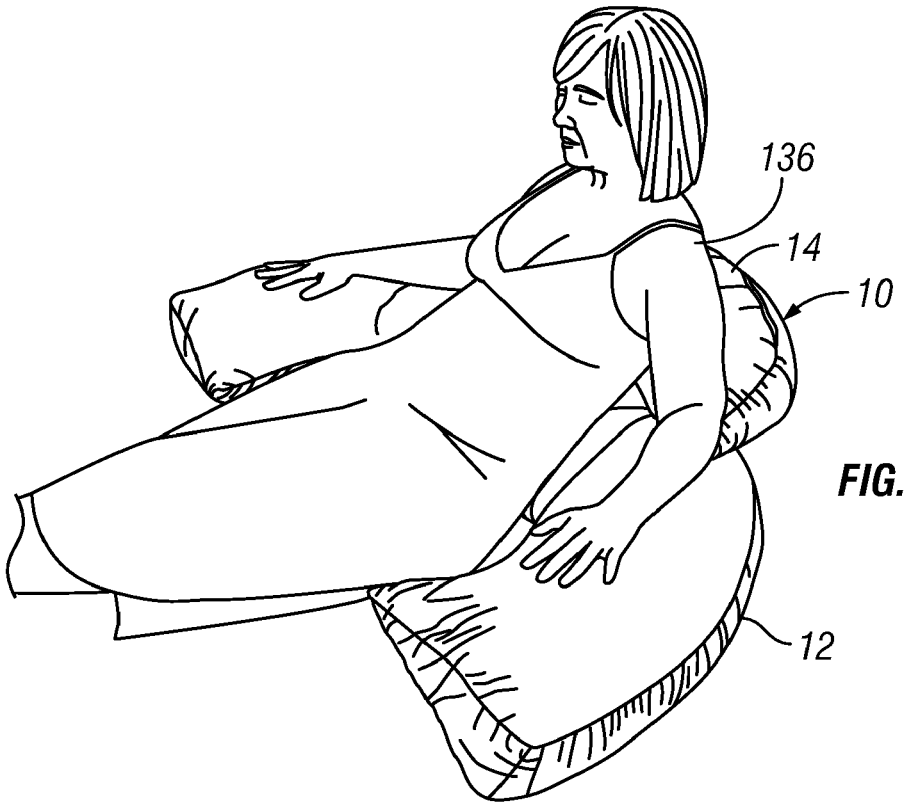
FIG. 19 is a side perspective view of the pillow assembly in the configuration shown on FIG. 18. A woman is seated in the pillow assembly with her back resting on the two stacked pillows.

Yet another configuration of the pillow assembly 10 is shown in FIG. 18. With edge 112 adjacent the inner perimeter 40 of the pillow 12, as in FIG. 13, the pillow 14 and pad 16 are folded up and over the body 34 of the long pillow 12 so that the short pillow is stacked on top of the long pillow. This provides a study pillow function; the ends of the long pillow 12 become armrests, while the stacked long and short pillows 12 and 14 provide back support in a sitting or semi-reclining position for any user 136, as illustrated in FIG. 19.

Figure 20:
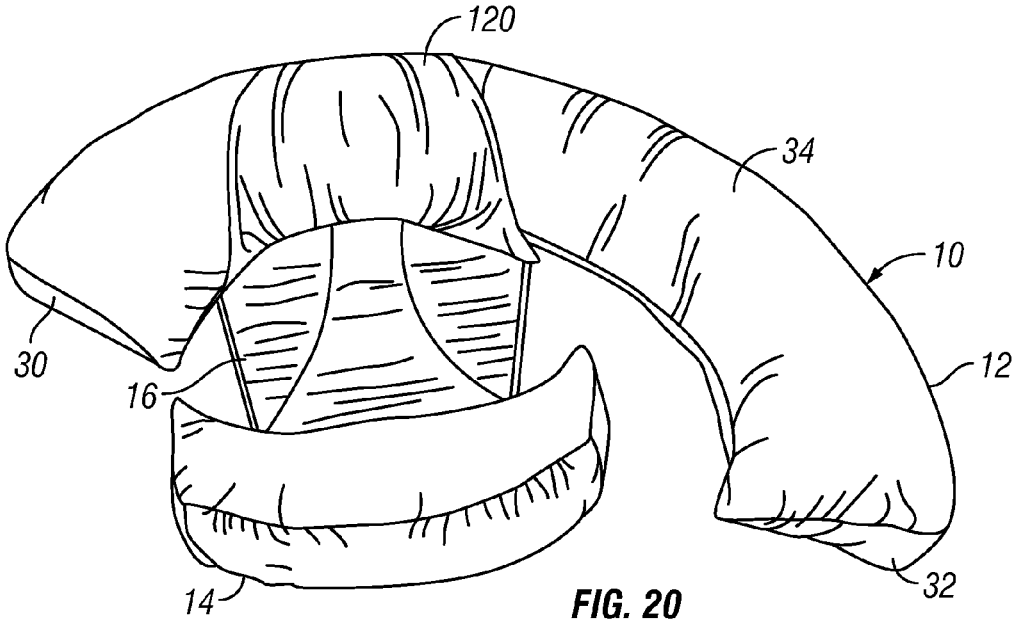
FIG. 20 is a front perspective view of the pillow assembly in yet another configuration, with the sleeve moved a distance toward one end of the long pillow.

Another configuration is shown in FIG. 20, where the sleeve 120 is moved toward the end 30. Although not depicted in the drawings, it will be apparent that this configuration offers additional body support options.

Figure 21:
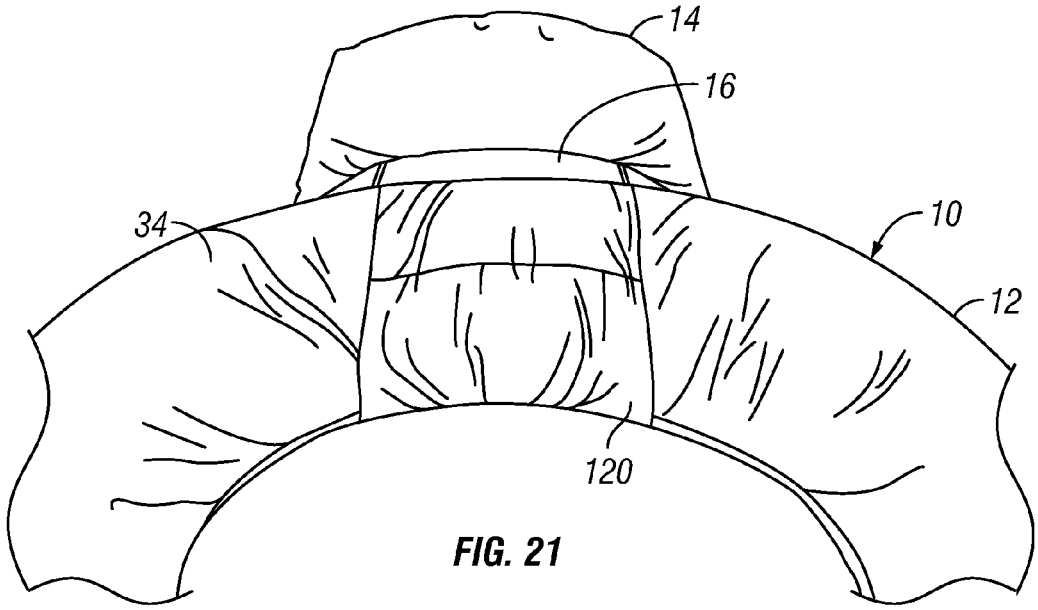
FIG. 21 is a front perspective view of the pillow assembly in yet another configuration, with the sleeve rotated 180 degrees on the long pillow so that the short pillow is on the other side of the long pillow.
Figure 22:
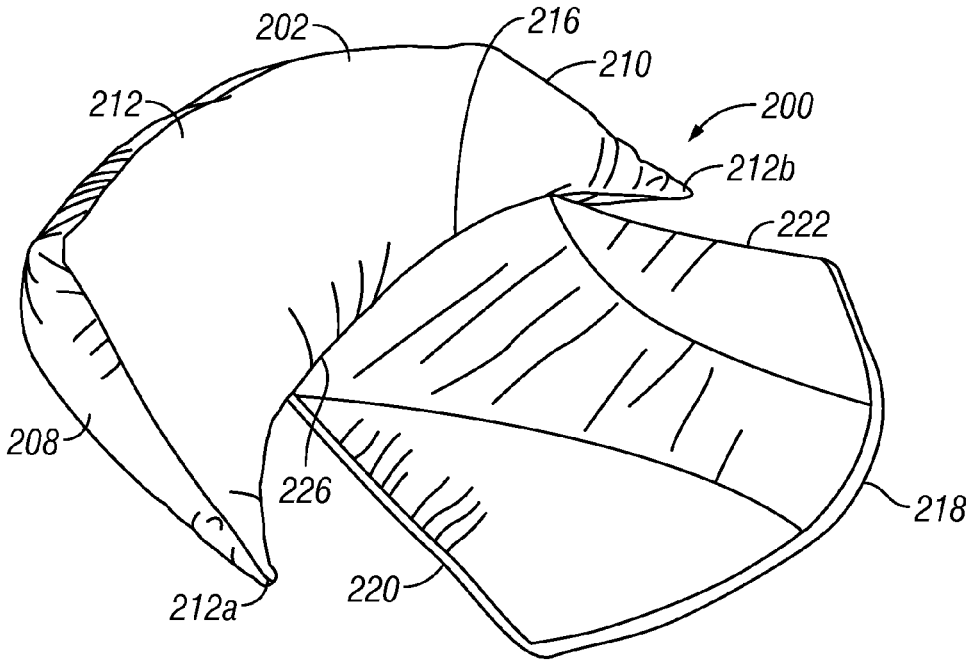
FIG. 22 is a side perspective view of a pillow assembly comprising a short pillow with attached underbody panel.
Figure 23:
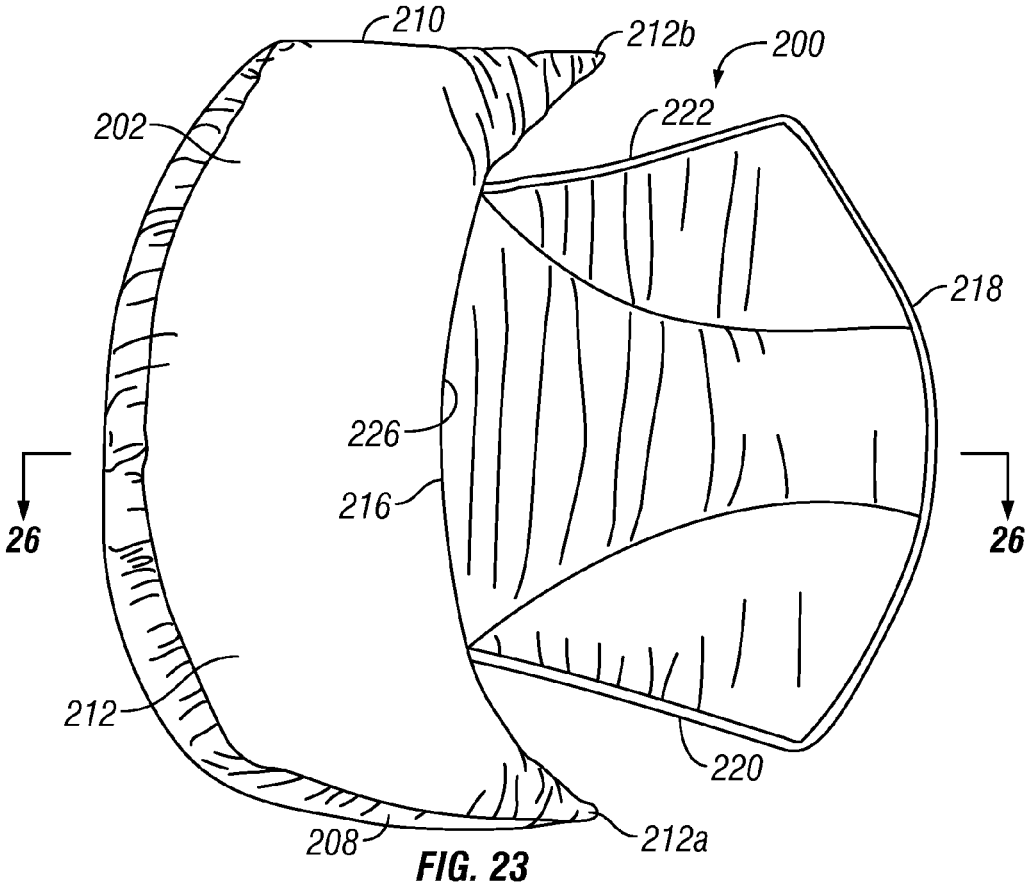
FIG. 23 is a plan view of the pillow assembly of FIG. 22.
Figure 24:
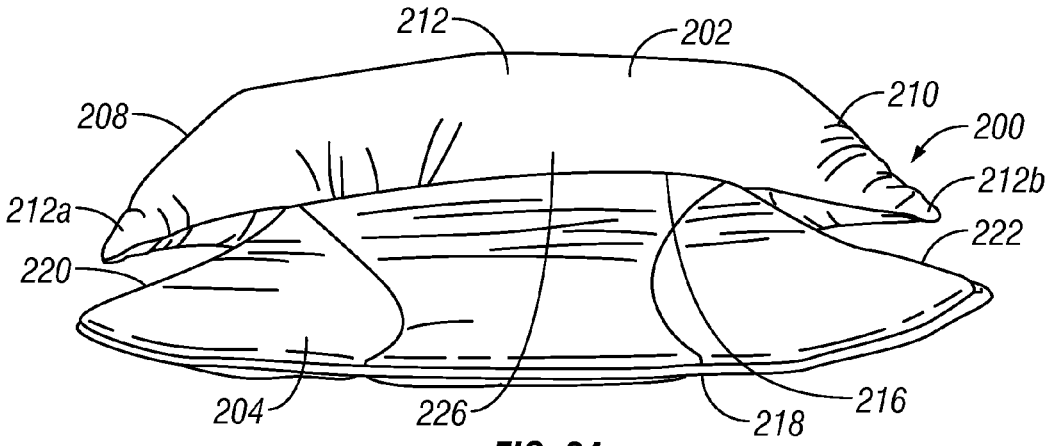
FIG. 24 is a front elevational view of the pillow assembly of FIG. 22.
Figure 25:
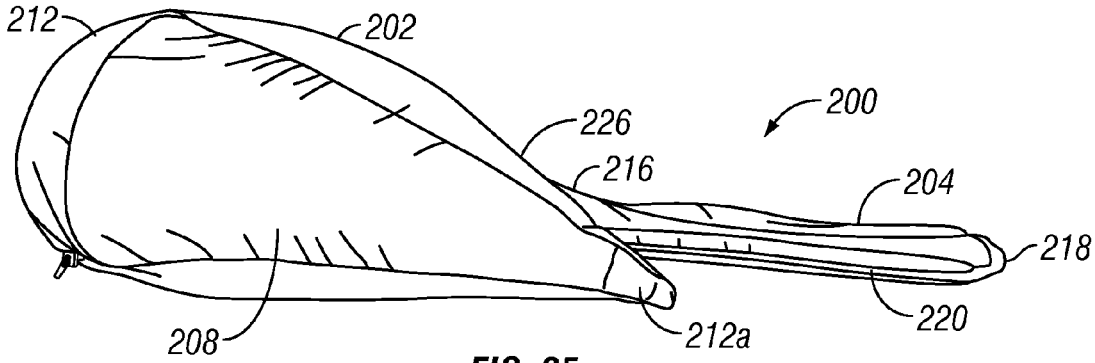
FIG. 25 is an end elevational view of the pillow assembly of FIG. 22.

In some cases, it may be desired to use the short pillow 14 as back support and the long pillow as frontal support with arms and legs extended across it. FIG. 21 shows how the sleeve 120 can be rotated 180 degrees around on the body 34, as compared to the position shown in FIG. 13. In this way, the short pillow 14 curves inward toward the back of the user (not shown) while the user faces the convex side of the long pillow 12.

While several possible configures of the pillow assembly 10 are shown and described, the pillow assembly is not limited to these. It will now be apparent that the pillow assembly 10 offers a wide range of positions and, thus, a large number of uses.

Turning now to FIGS. 22 to 26, a second embodiment of the pillow assembly, designated generally at 200, will be described. This pillow assembly 200 comprises a short pillow 202 and an underbody pad 204 made in manner similar to that described above in regard to the short pillow 14 and pad 16 of the embodiment 10 previously described.

Figure 26:
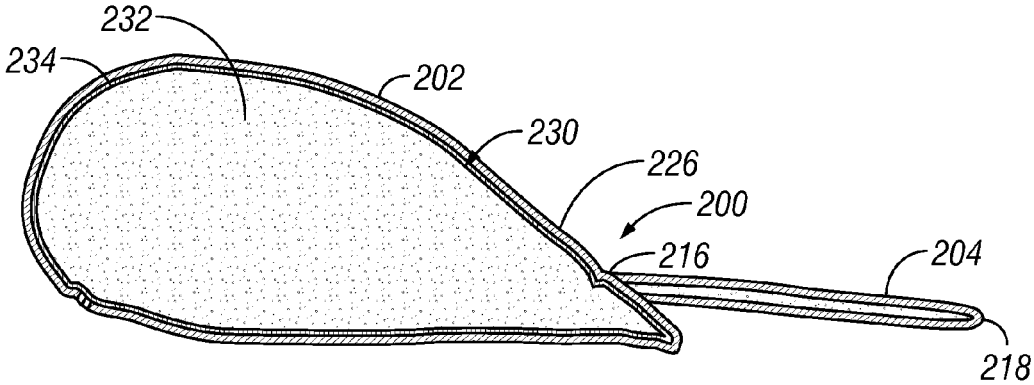
FIG. 26 is a cross-sectional view of the pillow assembly of FIG. 22 taken along line 26-26 in FIG. 23.

The pillow 202 has ends 208 and 210 and a body 212. The ends 208 and 210 have tapered inner corners 212*a* and 212*b*. The pad 204 comprises a first end edge 216, a second free end edge 218, and sides 220 and 222. The first end edge 216 extends from the inner perimeter 226 of the pillow body 212, as in the previous embodiment. As FIG. 26 shows, the pillow 202 may include a pillow form 230 comprising a filler material 232 contained in a fabric enclosure 234, all inside a removable cover 236.

Figure 27:
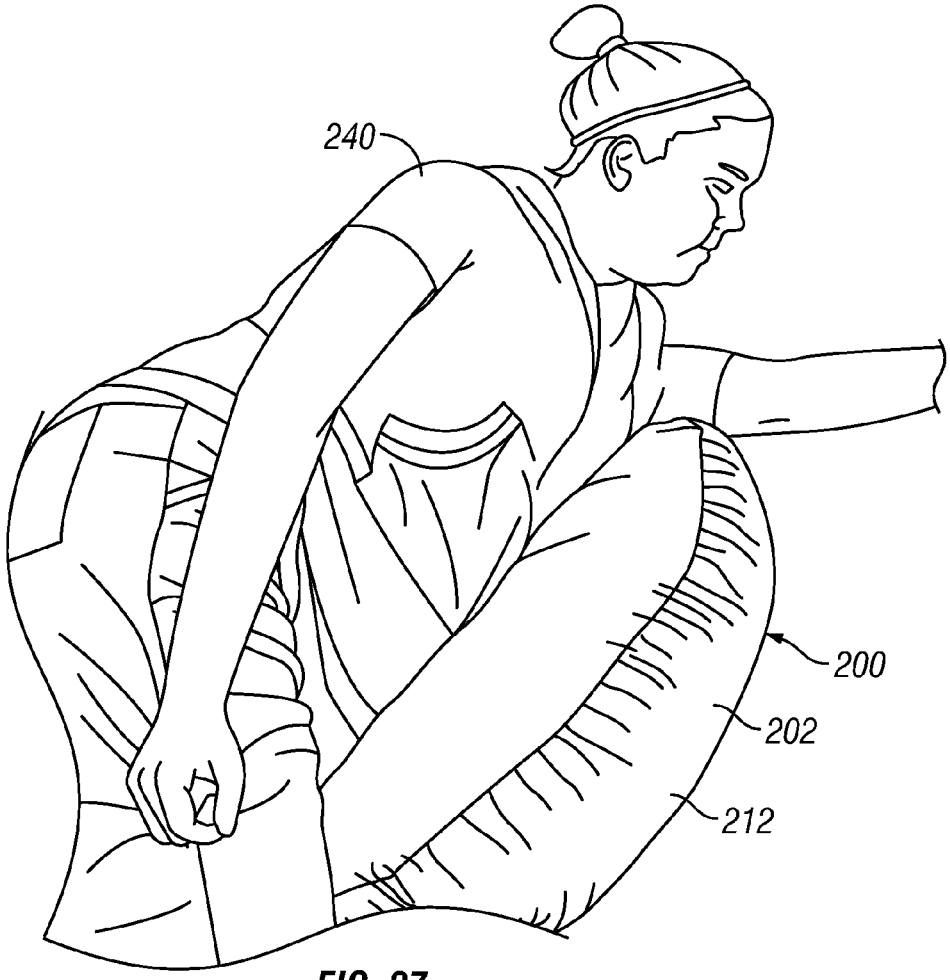
FIG. 27 is a perspective view of the pillow assembly of FIG. 22. A pregnant woman is lying on her side with her belly resting on the pillow.
Figure 28:
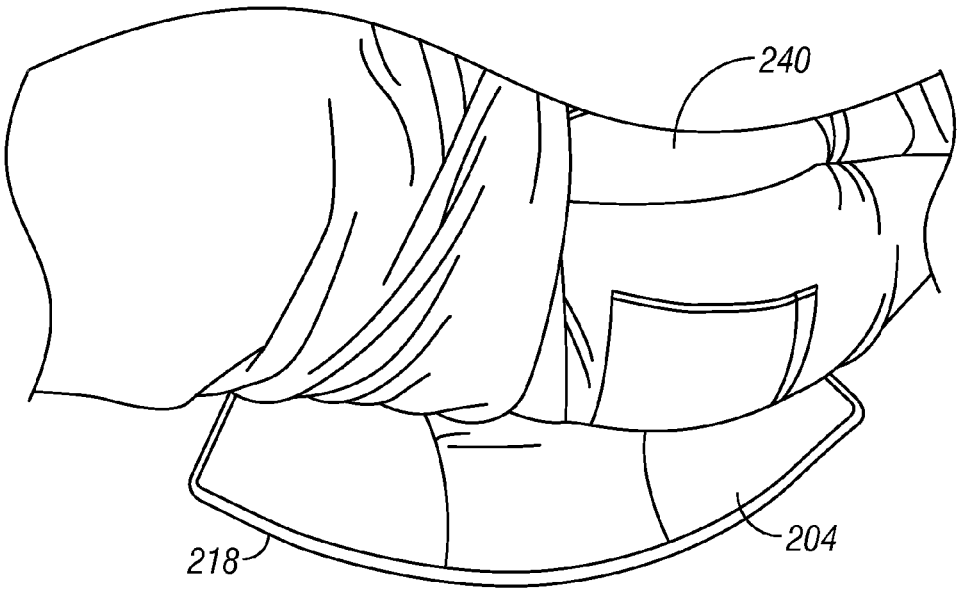
FIG. 28 is a perspective view of the pillow assembly in use as shown in FIG. 27 illustrating how the free edge of the under body panel extends under the woman's body.

As depicted in FIGS. 27 and 28, the pillow assembly 200 may be used as a back or belly support, with the user 240 leaning onto the pillow 202 while lying across the pad 204. The weight of the user 240 on the pad 204 maintains the pillow 202 in position securely.

Figure 29:
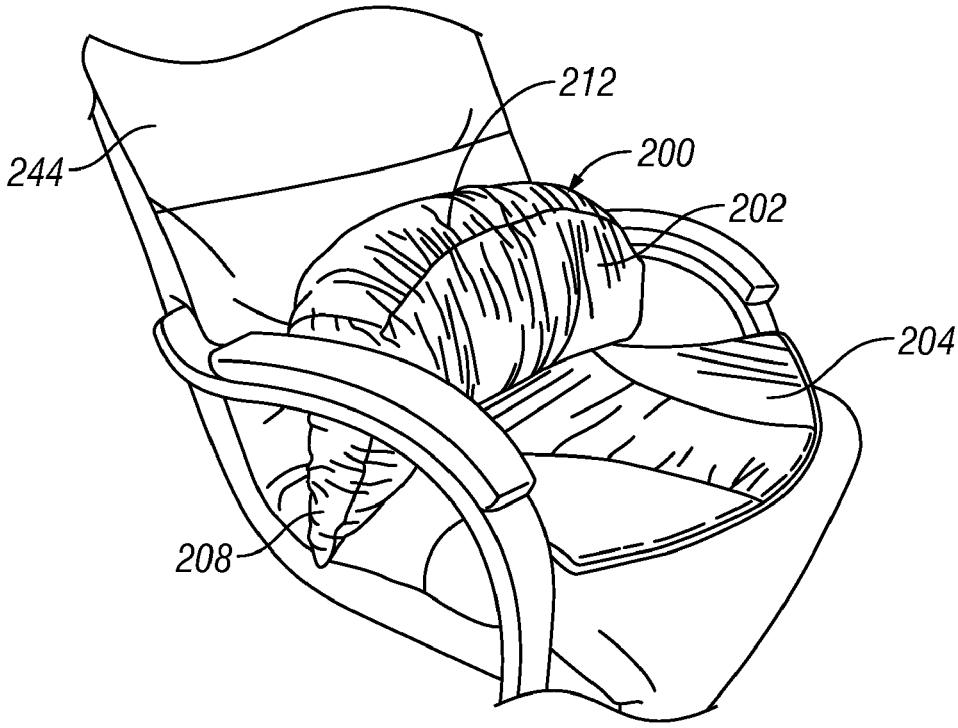
FIG. 29 is a side perspective view of the pillow assembly of FIG. 22 shown positioned as a back rest in a chair.
Figure 30:
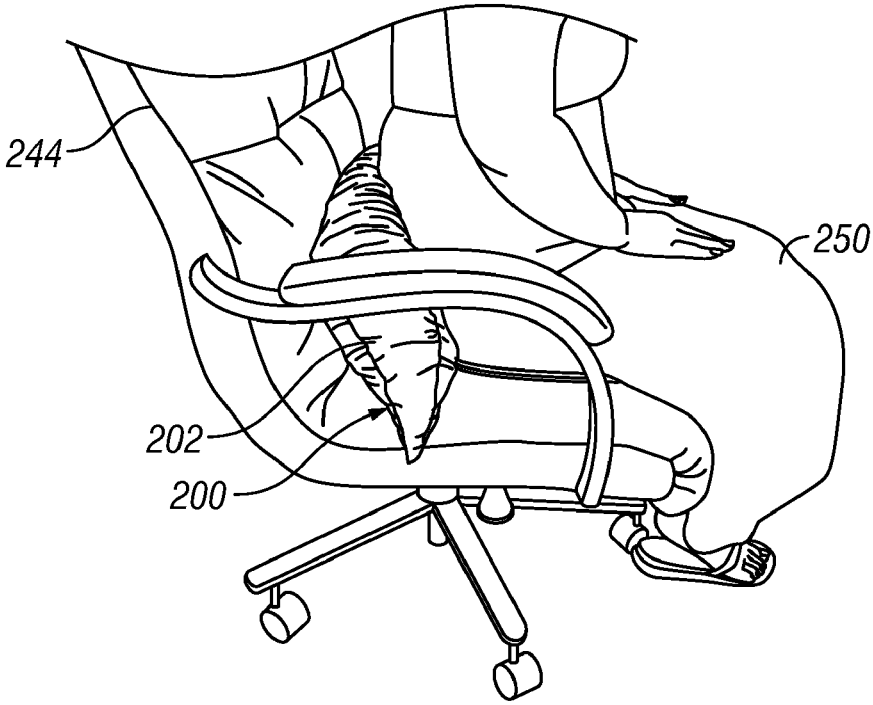
FIG. 30 is a side view of the pillow assembly and chair of FIG. 22. A woman is seated in the chair with the pillow supporting her lower back.

The pillow assembly 200 is also particularly useful as a back support for chairs, as shown in FIGS. 29 and 30. The pillow assembly 200 is placed in the chair 244 with the pillow 202 up against the back of the chair and so that the inner perimeter 226 of the pillow rests on the seat of the chair and the pad 204 extends across the seat. In this way, when the user 250 sits in the chair, the user's weight on the pad 204 holds the pillow 202 in position behind her lower back. This provides welcome support to pregnant woman and other, non-pregnant users alike.

As used herein, "resting position" refers to the position and shape the pillow component naturally assumes when no tension or pressure is exerted on any part it. For the purpose of this description, the words left, right, front, rear, top, bottom, high, low, upper, lower, up, down, inner, outer, inside, and outside may be used to describe the various parts and directions of the invention as depicted in the drawings. These relative descriptive terms are used for reference purposes only and should not be considered as limiting the possible orientations of the pillow components or how they may be used.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A pillow assembly comprising:

a long body pillow comprising a first end, a second end, and body portion extending therebetween, the body portion characterized by a circumference and a length;

a short pillow comprising a first end, a second end, and a body portion having a length, the length being shorter than the length of the long body pillow;

an underbody pad having a first side and a second opposite side, the first side attached to the inner perimeter of the short pillow;

a sleeve attached along its length to the second side of the underbody pad the length of the sleeve being shorter than the length of the long body pillow;

wherein the body portion of the long body pillow is slidably and rotatably received in the sleeve so that the position of the sleeve along the length of the long body pillow and the position of the sleeve relative to the circumference of the long body pillow both are independently adjustable.

2. The pillow assembly of claim 1 wherein the long body pillow is curved.

3. The pillow assembly of claim 2 wherein the short pillow is curved.

4. The pillow assembly of claim 1 wherein the short pillow is curved.

5. The pillow assembly of claim 1 wherein the length of the long body pillow is about twice the length of the short pillow.

6. The pillow assembly of claim 1 wherein the first and second ends of the long body pillow are tapered.

7. The pillow assembly of claim 6 wherein the first and second ends of the short pillow are tapered.

8. The pillow assembly of claim 1 wherein the first and second ends of the short pillow are tapered.

9. The pillow assembly of claim 1 further comprising a removable cover enclosing the long body pillow.

10. The pillow assembly of claim 9 further comprising a removable cover enclosing the short pillow.

11. The pillow assembly of claim 10 wherein the underbody pad is attached to the removable cover on the short pillow.

12. The pillow assembly of claim 11 wherein the first and second ends of the long body pillow and the first and second ends of the short pillow all are tapered.

13. The pillow assembly of claim 1 further comprising a removable cover enclosing the short pillow.

14. The pillow assembly of claim 1 wherein the underbody pad is permanently attached to the short pillow.

15. The pillow assembly of claim 1 wherein the length of the long pillow is about 40 to about 60 inches.

16. The pillow assembly of claim 15 wherein the length of the short pillow is about 15 to about 35 inches.

17. The pillow assembly of claim 1 wherein the length of the short pillow is about 15 to about 35 inches.

18. A pillow assembly comprising:

a pillow that is longer than it is wide and is curved along its length, is generally wedge-shaped in cross-section having an outer perimeter and an inner perimeter that is narrower than the outer perimeter, the inner perimeter terminating in tapered corners;

an underbody pad having a first edge extending from the inner perimeter of the pillow and a second free edge.

19. The pillow assembly of claim 18 wherein the pillow has a length between about 15 inches to about 35 inches.

20. The pillow assembly of claim 18 further comprising a removable cover enclosing the pillow.

21. The pillow assembly of claim 20 wherein the underbody pad is attached to the cover.

22. The pillow assembly of claim 21 wherein the underbody pad is permanently attached to the cover.

23. The pillow assembly of claim 18 wherein the underbody pad is permanently attached to the pillow.

* * * * *